United States Patent [19]

Haydu

[11] Patent Number: 4,676,842

[45] Date of Patent: Jun. 30, 1987

[54] PROTECTIVE COATING FOR METALS

[76] Inventor: Robert Haydu, P.O. Box 128, Skillman, N.J. 08558

[21] Appl. No.: 848,387

[22] Filed: Apr. 4, 1986

[51] Int. Cl.[4] ..... C23C 22/43

[52] U.S. Cl. ..... 148/6.2; 148/400

[58] Field of Search ..... 148/6.2, 31.5

[56] References Cited

U.S. PATENT DOCUMENTS

| | | | |
|---|---|---|---|
| 3,347,713 | 10/1967 | Lodeesen | 148/6.2 |
| 3,404,044 | 10/1968 | Russel | 148/6.2 |
| 3,410,707 | 11/1968 | Pecock | 148/6.2 |
| 3,752,708 | 8/1973 | Newell | 148/6.2 |
| 3,993,510 | 11/1976 | Bellguin | 148/6.2 |
| 3,998,670 | 12/1976 | Umeyano | 148/6.2 |
| 4,088,621 | 5/1978 | Miller | 148/6.16 |

*Primary Examiner*—Sam Silverberg

*Attorney, Agent, or Firm*—Laughlin, Markensohn, Lagani & Pegg

[57] ABSTRACT

Enhanced resistance to the corrosion of metals such as aluminum, zinc, magnesium and the like is achieved by the application of a metallo-gel film. The composition of the coating uniquely includes liquid manganese nitrate and sodium tungstate as accelerators which accelerate and activate the chromate sources to coat the metal surface being treated.

13 Claims, No Drawings

PROTECTIVE COATING FOR METALS

BACKGROUND OF THE INVENTION

This invention relates to the problem of corrosive action on metal surfaces such as aluminum, cadmium, magnesium and the like, paticularly when such metals are exposed to atmospheric pollution.

Atmospheric pollution in the form of acid rain, salt spray, chemicals such as sulfur dioxide and various particulate matter continues throughout industry to result in increasing levels of damaging corrosion on metal surfaces. It is well known that such corrosion is formed primarily from the interaction of metallic surfaces with atmospheric pollution, moisture and oxygen, particularly at elevated temperatures. Metals especially vulnerable to damaging corrosion are found in exposed climate control equipment, water cooling apparatus, and refrigeration systems with their evaporators and condensers that employ aluminum fin tubes as well as flat surfaces.

In the operation of such equipment there is a significant increase in energy costs incurred whenever operating efficiency or heat transfer coefficients are impaired by corrosion build-up or particulate deposits. Such action also clogs air passages between the fins of fin tubes. As a result, air flow necessary to dissipate or absorb heat is restricted and evaporators and condensers are unable to perform their intended functions. As operating efficiency drops, energy costs rise to a point where the need for power is continuous and the energy cost for operation is at a maximum. Should the unit continue to operate in this mode of decreased efficiency, accelerated deterioration of the exposed metal surfaces results. Costly equipment damage and shortened equipment life necessarily follow.

In the prior art, the use of a liquid chromate conversion coating as a corrosion inhibiting substance for the protection of aluminum and other metals is well known. Illustrative of such coatings are those disclosed in U.S. Pat. Nos. 4,088,621, issued May 9, 1978 to Russell C. Miller and 4,137,368, issued Jan. 30, 1979 to Russell C. Miller as well as a commercial product OAKITE L25 produced by OAKITE PRODUCTS INC. Nevertheless, prior art attempts to solve the problems outlined have not been fully successful. In some cases the protective procedures used have been unduly complicated by combining the coating with an organic resinous film. As a result, the cost of the process as well as the time required to apply the coating have been increased to undesirable levels. In other cases the protective process has been made unnecessarily complex by the sheer number of ingredients used to produce the coating. In other instances the particular mix of other ingredients with the chromate conversion coating together with the particular ingredient proportions used has caused coagulation, has produced sediment and has limited the capability of the mixture to form a uniform coating.

OBJECTS

Accordingly, one object of the invention is to enhance the effectiveness of inhibiting corrosion on metal surfaces such as aluminum by the use of a metallo-gel film coating.

Another object is to simplify the process employed in the formulation of the coating indicated.

An additional object is to reduce the cost of the process indicated.

A further object is to increase the speed of the process indicated.

SUMMARY OF THE INVENTION

A key feature of the invention is the use of a unique combination of accelerators as part of the formulation of a liquid metallo-gel film coating used to inhibit corrosion on metal surfaces such as aluminum.

Another feature of the invention is the elimination of a rinsing step that is conventionally used in a process that employs a liquid chromate conversion coating to inhibit corrosion on surfaces of aluminum and other metal surfaces.

These and additional objects and features of the invention will become evident from the following detailed description.

DETAILED DESCRIPTION

The below tabulation is a listing of those substances (together with their percentages by weight) that make up a formulation in accordance with the invention.

| Substance | Approximate Percentage by Weight |
|---|---|
| deionized water | Q.S. % |
| nitric acid | 0.45% |
| chromic acid | 1.60% |
| hydrofluoric acid | 0.30% |
| sodium bichromate | 0.80% |
| manganese nitrate | 0.30% |
| sodium tungstate | 0.40% |

It is understood, however, that the maximum concentrations by weight listed above need not be exact to fall within the scope of the invention. Instead, in practice, the maximum concentrations indicated may be reduced by a factor of 10 and the ratio of active ingredients may be varied by plus or minus 10% without departing from the formulation requirements of the invention.

Deionized water is normally utilized for the preparation of a concentrated solution prior to field dilution with either distilled or tap water. Deionized water is produced ideally by passing non deionized water through a mixed resin bed to remove hardness composents such as calcium and magnesium without adding any salts or chlorine to the water. Typically, the conductance of properly deionized water is less than 4.0 micromhos. Although deionized water is not essential in the practice of the invention, it is preferred for both product quality and shelf life.

In the preferred embodiment the metal surface to be coated is subject to a pre-cleaning step as follows:

a. An initial solvent degreasing step may be required to remove forming lubricant, fingerprints, and other organic deposits. A volatile, chlorinated solvent is generally utilized, typically a chlorinated/flourinated straight chain, saturated hydrocarbon containing one or two carbon atoms.

b. The surfaces are then prepared to accept the metallo-gel film coating by removal of the surface oxidation layer by application of a dilute phosphoric acid degreasing formulation containing ethozylated alcohol surfactants. The technology of utilizing a pure grade of phosphoric acid allows for any residual product in a crevice or bi-metallic interface to form a passive phosphate salt which is protective in itself and further enhances acceptance of the metallo-gel film.

The combination of hydrofluoric and nitric acid acts to prepare the aluminum or other metal surface to accept the reductive coating that is applied in accordance with the invention.

In accordance with the invention the chromic acid and sodium bichromate ingredients together serve as a source of hexavalent chromium (CRO3) in equilibrium, i.e. 2HCRO4− CR207− +h2O which is a primary substance in the protective coating that inhibits the formation of corrosion or oxidation on the metal surface to be protected.

In accordance with the invention, the compounds of sodium tungstate containing hexavalent tungston and liquid manganese nitrate operate uniquely and synergistically together as accelerators to promote the formation of the reductive chromate coating without subsequent application of upkeep coatings and at a treatment rate that exceeds the rate of chromate deposition achieved in known prior art processes.

In addition to the relatively high reaction rate achieved over that of prior art processes, the accelerators indicated remain as manganese and tungstate radicals bound in the chromate matrix. These radicals function as anodic corrosion inhibitors. As a result, processes employed in the prior art such as the final water rinse and the use of a final fixative required, for example, in the product known commercially as OAKITE CHROMICOAT L25 are not required in the process taught by the invention disclosed herein.

Application of a coating in accordance with the invention may be carried out by means of spraying or by dipping. In either case, a coating applied in accordance with the invention calls for a coating temperature in the approximate range of 20°-120° F. and a coating thickness in the approximate range of 0.05 to 0.08 mg/sq. ft. Coatings consisting of the formulation described herein and applied in the manner indicated substantially exceed the requirements of the military specification, MIL-C-5541B. Specifically, the military requirements call for no evidence of corrosive attack after at least 168 hours of continuous exposure to the spray of a 5% sodium chloride solution at 95° F. Under the test conditions indicated, an aluminum surface with a coating in accordance with the invention showed no evidence of corrosion after 336 hours of exposure.

This process produces a protective metallo-gel film which is molecularly bonded to the surface of the base metal, forming a protective coating of approximately 80 mg. per square foot. The coating has no effect on the heat transfer coefficients. The protective coating contains unique accelerators which are themselves functional, anodic corrosive inhibitors. The coating obtained protects against acids, sulfur dioxides, alkalides, salt water, acid rain, chloric vapors and mists as well as a host of other commercial and industrial aggressive corrosive atmospheres. The coating will not crash, chip or peel and has an excellent UV rating. It remains flexible (300% flexibility) over a wide range of temperatures from minus thirty (−30° F.) degrees Fahrenheit to 200° F.

In the preferred embodiment a seal or top coat is applied to remove any porosity of the protective coating. The thickness of such a coating is preferably from about 0.001 to about 0.010 inches. This seal coating is preferably a synthetic rubber composition such as neoprene or acrylontrile. A typical formulation is as follows:

| Substance | Approximate Percentage by Weight |
|---|---|
| Kraton* | 14.50% |
| Chlorinated Hydrocarbon (1,1,1-trichlorethane) | 55.50% |
| Naphtha | 17.00% |
| Methylene Chloride | 8.50% |
| Toluene | 3.50% |
| Mineral Spirits | 0.25% |
| Silicon Dioxide (Amorphous) | 0.75% |

*A trademark of Shell Oil Co.

Although a basic description of the invention has been set forth herein, it is to be understood that various modifications can be employed without departing from the spirit and scope of the invention.

What is claimed is:

1. In a chromate conversion formulation for coating metal to inhibit corrosion on the surface of said metal, the inclusion of manganese nitrate as a first accelerator and sodium tungstate as a second accelerator.

2. The formulation in accordance with claim 1 wherein the percentage by weight of said first accelerator is apparently 0.3% and the percentage by weight of said second accelerator is apparently 0.4%.

3. The formulation in accordance with claim 2 including sodium bichromate as a first source of hexavalent chromium and chromic acid flake as a second source of hexavalent chromium.

4. The formulation in accordance with claim 1 wherein said metal is aluminum.

5. A chromate conversion formultion for coating aluminum and similar metals to inhibit corrosive action, said formulation comprising:

| Substance | Approximate Percentage by Weight |
|---|---|
| deionized water | Q.S. % |
| nitric acid | 0.45% |
| chromic acid | 1.60% |
| hydrofluoric acid | 0.30% |
| sodium bichromate | 0.80% |
| manganese nitrate | 0.30% |
| sodium tungstate | 0.40% |

6. The formulation in accordance with claim 5 wherein said coating is applied by spraying.

7. A formulation in accordance with claim 5 wherein said coating is applied by dipping.

8. A process for protecting exposed metal surfaces comprising the steps of:

preparing a formulation for producing a chromium containing metallo-gel film which includes manganese nitrate and sodium tungstate as accelerators, and applying said formulations to said surfaces.

9. The process in accordance with claim 8 wherein said formulation is applied at a temperature in the range of 90° to 120° F.

10. The process in accordance with claim 8 wherein the thickness of the coating of said formulation applied to said surfaces is in the range of 0.05 to 0.08 mg/sq. ft.

11. A process in accordance with claim 8 wherein said formulation comprises the following substances:

| Substance | Approximate Percentage by Weight |
|---|---|
| deionized water | Q.S. % |
| nitric acid | 0.45% |
| chromic acid | 1.60% |
| hydrofluoric acid | 0.30% |
| sodium bichromate | 0.80% |
| manganese nitrate | 0.30% |

-continued

| Substance | Approximate Percentage by Weight |
|---|---|
| sodium tungstate | 0.40% |

12. A metal surface exposed to air, protected with a coating of a chromium containing metallo-gel film which includes manganese nitrate and sodium tungstate as accelerators.

13. The metal surface of claim 12 containing a top seal coat of a synthetic rubber composition.

* * * * *